US007161612B2

(12) United States Patent
Kamimura

(10) Patent No.: US 7,161,612 B2
(45) Date of Patent: Jan. 9, 2007

(54) IMAGE FORMING APPARATUS, PROCESS CARTRIDGE AND EXPOSURE SCANNING UNIT

(75) Inventor: Naoya Kamimura, Nagoya (JP)

(73) Assignee: Brother Kogyo Kabushik Kaisha, Nagoya (JP)

( * ) Notice: Subject to any disclaimer, the term of this patent is extended or adjusted under 35 U.S.C. 154(b) by 185 days.

(21) Appl. No.: 11/030,130

(22) Filed: Jan. 7, 2005

(65) Prior Publication Data

US 2005/0151822 A1 Jul. 14, 2005

(30) Foreign Application Priority Data

Jan. 14, 2004 (JP) ..... 2004-007269

(51) Int. Cl.
*G03G 21/16* (2006.01)
*G03G 21/18* (2006.01)
*G03G 15/04* (2006.01)

(52) U.S. Cl. ..... 347/238; 399/107; 399/110; 399/111; 347/241; 347/242; 347/257; 347/258

(58) Field of Classification Search ..... 347/232, 347/233, 238, 241, 242, 256, 257
See application file for complete search history.

(56) References Cited

U.S. PATENT DOCUMENTS 6,477,348 B1 * 11/2002 Miyamoto et al. ..... 399/299
6,484,003 B1 * 11/2002 Tokutake et al. ..... 399/110
6,785,492 B1 * 8/2004 Tanizaki et al. ..... 399/113
6,799,011 B1 * 9/2004 Abe et al. ..... 399/299
6,943,817 B1 * 9/2005 Tanizaki et al. ..... 347/244
7,002,608 B1 * 2/2006 Sato ..... 347/115
2004/0228656 A1 * 11/2004 Kamimura ..... 399/149

FOREIGN PATENT DOCUMENTS

JP A 2003-015378 1/2003

* cited by examiner

*Primary Examiner*—Huan TRan
(74) *Attorney, Agent, or Firm*—Oliff & Berridge, PLC

(57) ABSTRACT

In a color laser printer, each scanner unit as an exposure scanning unit is positioned on a lateral side of a developing unit, so as not to face the surface of a photoconductor drum as a photoconductor. The scanner unit emits a laser light scanned in a direction perpendicular to a rotation axis of the photoconductor drum. A last mirror, having a reflecting surface at an angle of 45° with respect to the direction of the rotation axis of the photoconductor drum, is arranged to face the surface of the photoconductor drum. The last mirror reflects the laser light emitted by the scanner unit in the direction of the rotation axis of the photoconductor drum and changes the traveling direction by 90° to irradiate the surface of the photoconductor drum. This configuration allows a process cartridge including the developing unit to be attached and detached from above.

20 Claims, 15 Drawing Sheets

IMAGE FORMING APPARATUS, PROCESS CARTRIDGE AND EXPOSURE SCANNING UNIT

BACKGROUND OF THE INVENTION (i) Field of the Invention

The present invention relates to an image forming apparatus configured to form an electrostatic latent image by exposing an electrically charged photo conductor with a laser, and a process cartridge and an exposure scanning unit for use in such an image forming apparatus.

(ii) Background Art

An example of a conventional image forming apparatus is a so-called tandem color laser printer in which a plurality of photoconductor drums corresponding to a plurality of printing colors are arranged in parallel along belt members, such as a paper conveyor belt and an intermediate transfer printing belt.

In such a color laser printer, the surface of each rotatingly driven photoconductor drum is electrically charged evenly by a charger. When the electrically charged surface of each photoconductor drum is irradiated with a laser light in a scanning manner at a high speed by a scanner unit, an electrostatic latent image is formed. Then, the electrostatic latent image is developed with toner by a developing unit to form a toner image on the surface of each photoconductor drum. In this case, since the toner used for the developing unit is a consumable item, at least a process cartridge having the developing unit as a constituent element is usually configured to be attachable/detachable to/from a printer main body.

In such a tandem color laser printer, the chargers, the scanner units, the developing units, and the like for forming toner images on the surfaces of the respective photoconductor drums are required to be arranged so as to face the surfaces of the respective photoconductor drums. Since the scanner units and the developing units are relatively large because of their structures, arrangement of scanners and developing units alternately so as to face a plurality of photoconductor drums requires a long distance between the photoconductors. This will lead to a problem of an increased size of the color laser printer.

To shorten the distance between the photoconductors, a scanner unit may be arranged so as to face the surfaces of photoconductor drums with developing units located therebetween, as disclosed in the Publication of Unexamined Japanese Patent Application No. 2003-15378, such that the scanner unit is not located between the developing units.

SUMMARY OF THE INVENTION

In a tandem color laser printer as described above, it is preferable that process cartridges are designed to be detached in a direction departing from a belt member, from the viewpoint of operability when attaching/detaching the process cartridges.

However, according to the structure disclosed in the Publication of Unexamined Japanese Patent Application No. 2003-15378, the process cartridges cannot be detached in a direction departing from the belt member, since the scanner unit is disposed on a side opposite to a side of the process cartridges facing the belt member. In this structure, the process cartridges are attached and detached by first lifting a frame, to which four process cartridges are fixed, and then pulling out the frame in a sliding manner. This structure leads to a reduced operability compared with a structure of detaching process cartridges in a direction departing from a belt member, and to a complex mechanism of a color laser printer and a resulting increased manufacturing cost.

As described above, a conventional structure requiring arrangement of an exposure scanning unit so as to face the surface of a photoconductor involves various problems.

The present invention, which has been made in view of these problems, has an object to increase flexibility of arrangement of an exposure scanning unit with respect to a photoconductor.

To attain the above object, there is provided an image forming apparatus which comprises: a rotatable endless belt; rotatable photoconductors of N in number ($N \geqq 2$) arranged side by side along the endless belt; charging devices of N in number provided corresponding to the respective photoconductors of N in number that charge surfaces of the photoconductors; exposure devices that expose the photoconductors charged by the charging devices to form electrostatic latent images on the photoconductors; developing devices of N in number provided corresponding to the respective photoconductor of N in number that respectively develop the electrostatic latent images on the photoconductors with developing agents in different colors to form developing agent images. In the present image forming apparatus, process cartridges including at least the developing devices are provided in an attachable and detachable manner.

In the present image forming apparatus, the exposure device includes an exposure scanning unit that emits a laser light scanned in a same plane and at a specified angle; and a direction changing device that changes the direction of the laser light emitted by the exposure scanning unit such that a center line of the laser light after a direction change is directed not to pass a specific plane. The "specific plane" here means a plane which satisfies the conditions of the following (1) and (2):

(1) Including a center line of the laser light before the direction change.

(2) Being perpendicular to a plane in which the laser light before the direction change is scanned.

An explanation will be provided with respect to a specific example.

FIG. 12 and FIG. 13 are explanatory views for illustrating a direction change not corresponding to a direction change by the direction changing device of the present invention.

FIG. 12 shows a state in which a laser light L scanned in a plane A1 and at a specific angle is changed in its direction on a line M perpendicular to a center line C1 of the laser light, and thereby changed into a laser light L scanned in a plane A2 and at a specific angle having a center line C2.

FIG. 13 shows the same state viewed from a direction perpendicular to the plane A (i.e. the direction of an arrow z in FIG. 12). A plane B indicated by a linear line extending in a right and left direction in FIG. 13 (The linear line indicating the plane B, the center line C1 and the center line C2 are on the same linear line in this figure.) is a plane that includes the center line C1 of the laser light L before the direction change, and is perpendicular to the plane A1 in which the laser light L before the direction change is scanned. That is, the plane B is a plane that satisfies the above-mentioned conditions (1) and (2). Since the center line C2 of the laser light L after the direction change passes through the plane B, the direction change in this example does not correspond to a direction change by the direction changing device of the present invention.

In the case of the direction change as above, a scanning direction s1 of the laser light L before the direction change and a scanning direction s2 of the laser light L after the direction change are in the same direction, i.e. the scanning direction is not changed. A linear line M is a linear line in the same direction as the scanning directions s1 and s2.

The direction change as above is performed in the case of changing the direction of a laser light (e.g. when reflecting the laser light by a mirror in a scanner unit) in a conventional image forming apparatus (e.g. a printer).

FIG. 14 and FIG. 15 are explanatory views for illustrating a direction change corresponding to a direction change by the direction changing device of the present invention.

FIG. 14 shows a state in which a laser light L scanned in a plane A and at a specific angle is changed in its direction on a line M not perpendicular to a center line C1 of the laser light (a given direction except a perpendicular direction), and thereby changed into a laser light L scanned in the same plane A and at a specific angle having a center line C2.

FIG. 15 shows the same state viewed from a direction perpendicular to the plane A (i.e. the direction of an arrow z in FIG. 14). A plane B indicated by a linear line extending in a right and left direction in FIG. 15 (The linear line indicating the plane B and the center line C1 are on the same linear line in this figure.) is a plane that includes the center line C1 of the laser light L before the direction change, and is perpendicular to the plane A in which the laser light L before the direction change is scanned, in the same manner as in FIG. 13. That is, the plane B is a plane that satisfies the above-mentioned conditions (1) and (2). Since the center line C2 of the laser light L after the direction change does not pass through the plane B, the direction change in this example corresponds to a direction change by the direction changing device of the present invention.

Although the laser light L after the direction change is scanned in the same plane A as before the direction change in this example, this is not always required. For example, even when the center line CS of the laser light after the direction change does not pass through the plane A, the direction change may correspond to a direction change by the direction changing device of the present invention as long as the center line C2 does not pass through the plane B.

In the case of such a direction change, a scanning direction s1 of the laser light L before the direction change and a scanning direction s2 of the laser light L after the direction change are in different directions. (That is the scanning direction is changed.)

As clarified by the above explanation, the center line of a laser light emitted by the exposure scanning unit to the photoconductor necessarily passes through a plane (the plane B) regardless of any change in direction, according to the structure without the direction changing device of the present invention (FIG. 12, FIG. 13). This limits the positional relationship of the exposure scanning unit with respect to the photoconductor. Specifically, it is necessary to arrange the exposure scanning unit so as to face the surface of the photoconductor (the surface to be exposed). This will cause the exposure scanning unit to obstruct attachment/detachment of a process cartridge provided so as to face the surface of the photoconductor, when downsizing of an image forming apparatus is intended by shortening the distance between the photoconductors.

In contrast, the image forming apparatus of the present invention facilitates an increased flexibility in arrangement of the exposure scanning unit with respect to the photo conductor by using the direction changing device. According to the present image forming apparatus, it is possible to achieve down-sizing of the image forming apparatus by shortening the distance between the photoconductors, and also to prevent attachment/detachment of the process cartridge from being obstructed by the exposure scanning unit.

The present image forming apparatus may be configured, for example, as described in the following (a) through (f).

(a) The photoconductor may be, for example, cylindrical (drum-shaped) or belt-shaped.

(b) The photoconductors of N in number may be arranged, for example, side by side in a horizontal direction along an endless belt. When the photoconductors are arranged side by side in a horizontal direction in this manner, each developing device is located above each photoconductor, which enables attachment/detachment of the process cartridge including the developing device from above.

(c) The process cartridge may include, for example, a photoconductor or a charging device as an element.

(d) The exposure scanning unit may be configured, for example, to include a laser light source that emits a laser light, a scanning device that scans the laser light generated by the laser light source (e.g. a polygon mirror) and an fθ lens.

(e) The exposure scanning unit is preferably arranged on a lateral side of the photoconductor (on a side of an end of the photoconductor in the rotation axis). This may avoid obstruction by the exposure scanning unit when the process cartridge is detached in a direction departing from the endless belt.

(f) The direction changing device may be configured, for example, by a mirror or a lens.

In another aspect of the present invention, the exposure device in the present image forming apparatus includes an exposure scanning unit that emits a laser light scanned in a direction different from a direction of a rotation axis of the photoconductor, and a direction changing device that changes the direction of the laser light emitted by the exposure scanning unit such that the laser light is scanned in the same direction as the direction of the rotation axis of the photoconductor.

According to the present image forming apparatus, an increased flexibility in arrangement of the exposure scanning unit with respect to the photo conductor can be achieved since it is unnecessary for the exposure scanning unit to emit a laser light scanned in the same direction as the direction of the rotation axis of the photoconductor. It is, therefore, possible to achieve down-sizing of the image forming apparatus by shortening the distance between the photoconductors, and also to prevent attachment/detachment of the process cartridge from being obstructed by the exposure scanning unit.

When a belt-shaped photoconductor is employed, "the direction of the rotation axis of the photoconductor" means the direction of a line perpendicular to a flat plane including the path of a given point on the photoconductor moving as a result of rotation of the belt-shaped photoconductor. For example, when a roller is provided to rotate the belt-shaped photoconductor, "the direction of the rotation axis of the photoconductor" means the direction of the rotation axis of the roller.

In a further aspect of the present invention, the exposure scanning units in the present image forming apparatus are provided corresponding to the respective photoconductors of N in number and arranged side by side such that the respective exposure scanning units partially overlap the neighboring exposure scanning units. According to such a configuration, the distance between the exposure scanning units may be further shortened, and thereby down-sizing of the image forming apparatus may be achieved.

In a still further aspect of the present invention, the direction changing device in the present image forming apparatus is a mirror having a reflecting surface arranged at an angle of 45° with respect to a rotation axis of the photoconductor. According to such a configuration, the laser light emitted by the exposure scanning unit from the direction of the rotation axis of the photoconductor can be changed in direction by 90 degrees, thereby to irradiate the photoconductor. In addition, since it is possible to obtain the same distance of traveling of the laser lights in both configurations of with/without using a direction changing device of the present invention, an fθ lens employed in a conventional exposure scanning unit may be used without modification.

In another aspect of the present invention, the direction changing device in the present image forming apparatus is provided integrally with the process cartridge. According to such a configuration, obstruction of attachment/detachment of the process cartridge by the direction changing device may be avoided.

In a still another aspect of the present invention, the direction changing device in the present image forming apparatus is attached to the main body of the image forming apparatus. According to such a configuration, an increased positioning accuracy of the direction changing device way be achieved.

In a further aspect of the present invention, the direction changing device in the present image forming apparatus is provided integrally with the exposure scanning unit, and thereby an extremely high positioning accuracy of the direction changing device with respect to the exposure scanning unit may be achieved.

In a still further aspect of the present invention, the process cartridge in the present image forming apparatus does not include a photoconductor as an element, but a photoconductor is designed to be attachable and detachable in a direction of the rotation axis of the photoconductor. According to such a configuration, obstruction of attachment/detachment of the photoconductor by the direction changing device may be avoided. Therefore, the distance between the photoconductors may be further shortened.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENT

Figure 1:
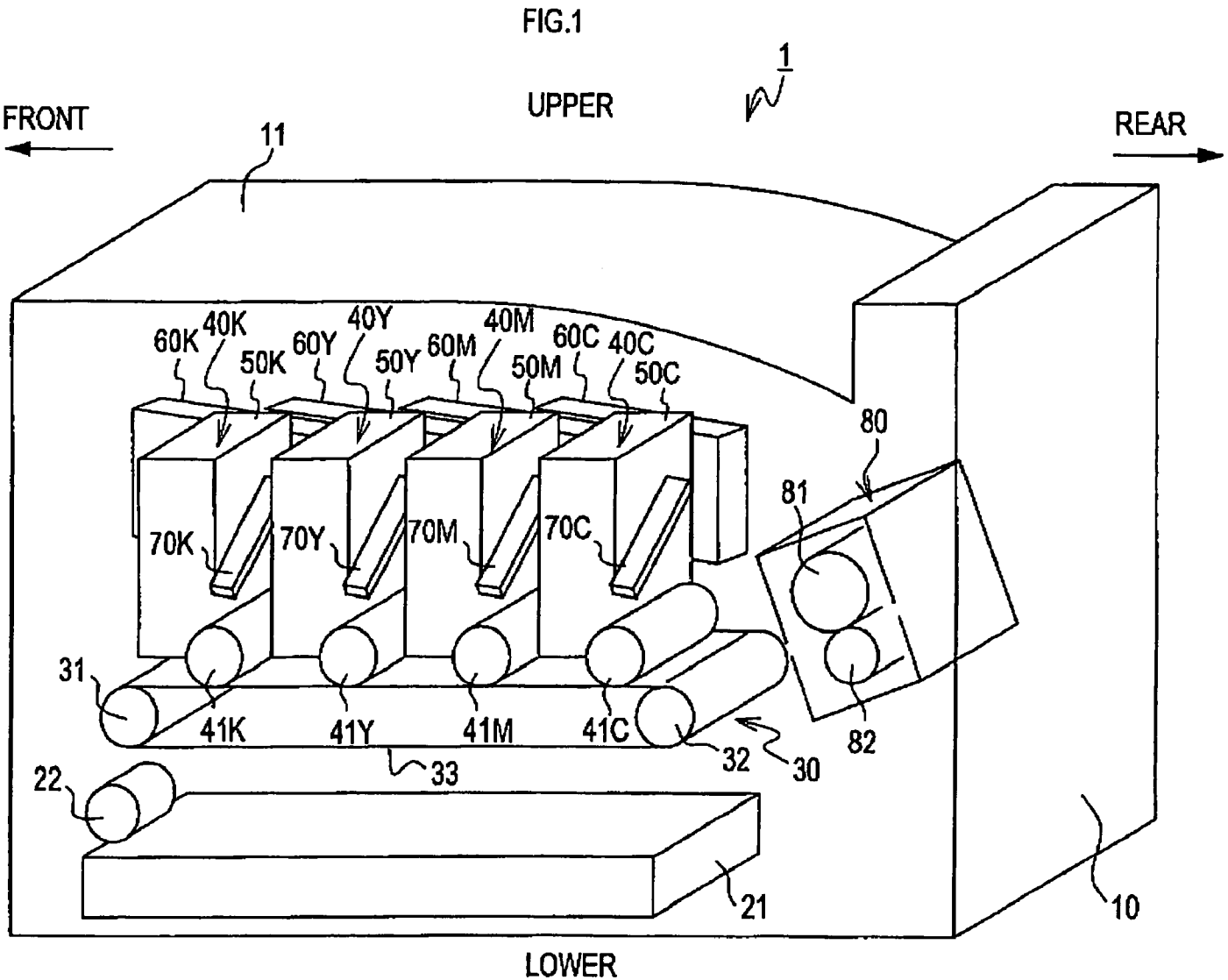
FIG. 1 is a diagrammatic perspective view of a color laser printer of the embodiment.
Figure 2:
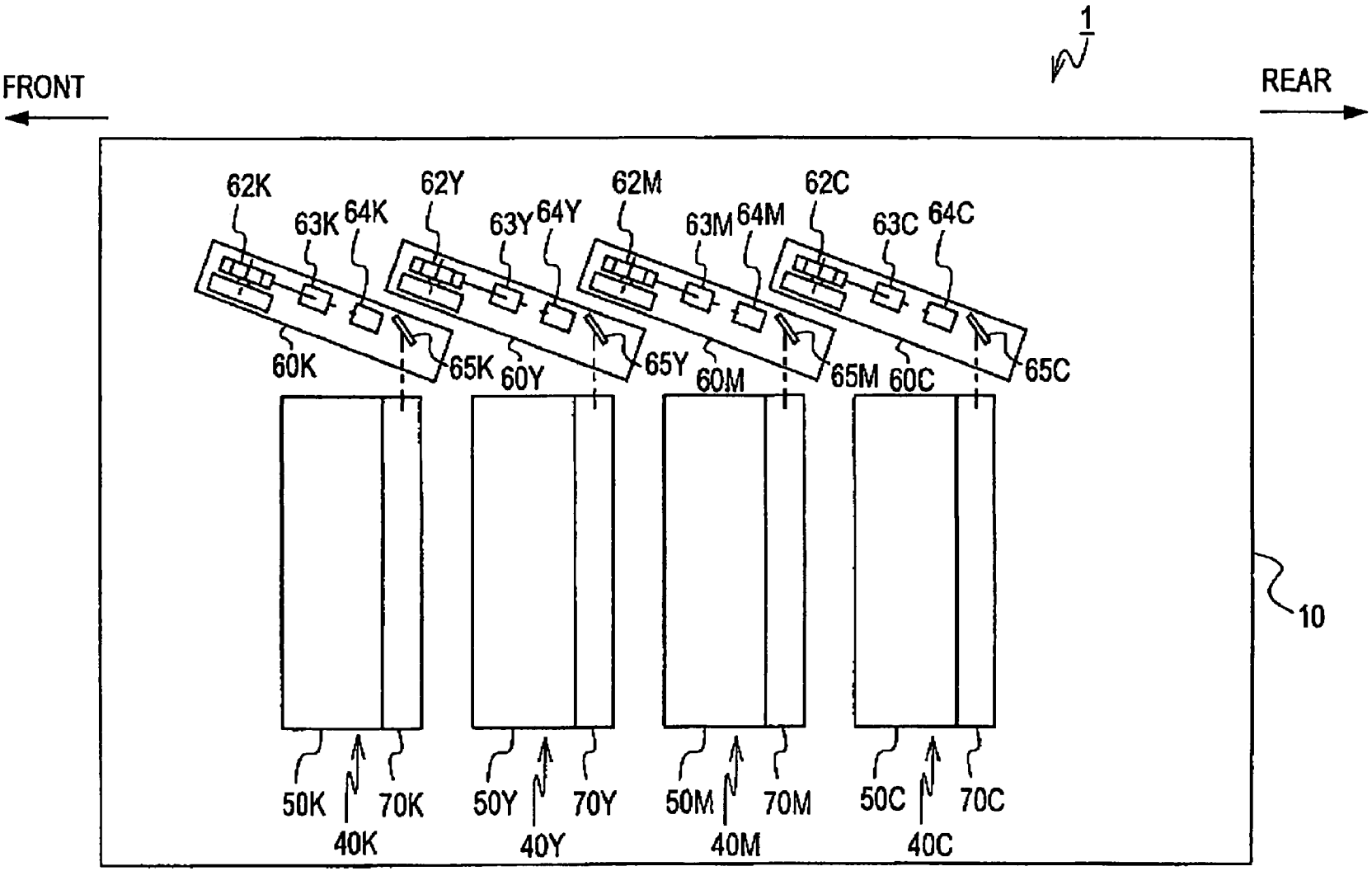
FIG. 2 is a diagrammatic cross-sectional view of the color laser printer of the embodiment seen from an upper side.
Figure 3:
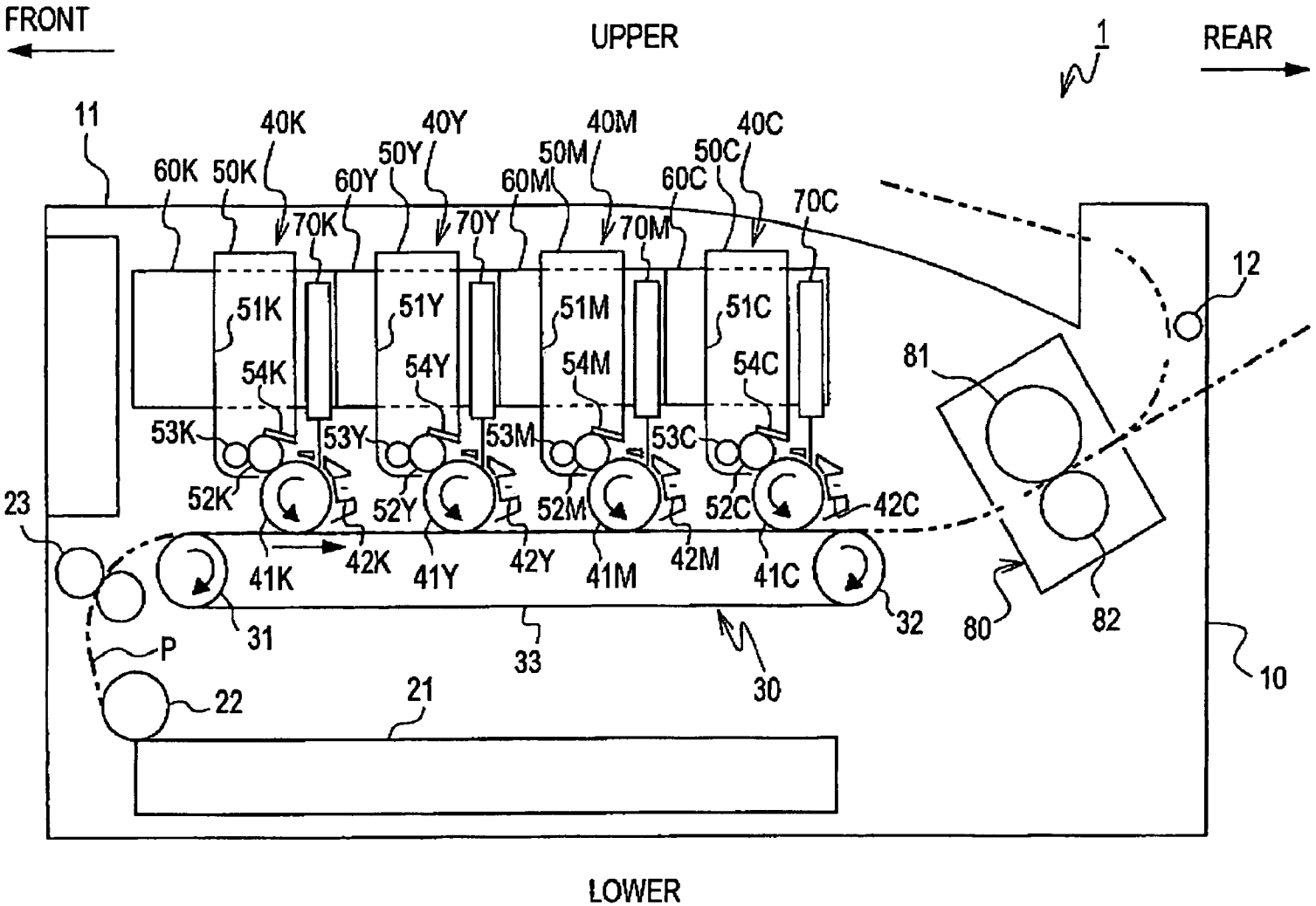
FIG. 3 is a diagrammatic cross-sectional view of the color laser printer of the embodiment seen from a lateral side.

As shown in FIGS. 1 to 3, a color laser printer 1, which is a tandem printer, is provided with a main body casing 10 defining the appearance of the color laser printer 1, and with a paper feed tray 21, a paper feed roller, a conveyor 30, four process cartridges 40K, 40Y, 40M and 40C, four scanner units 60K, 60Y, 60M and 60C, four last mirrors 70K, 70Y, 70M and 70C, and a fixing unit 80, all housed in the main body casing 10.

The paper feed tray 21 adapted to load a stacked plurality of sheets of paper P is disposed at the bottom of the main body casing 10 so as to be attachable/detachable from the front side.

The paper feed roller 22 is disposed above the paper feed tray 21 and on the front side of the color laser printer 1. The paper feed roller 22 rotatingly driven by a not-shown motor draws the paper P loaded in the paper tray 21 sheet by sheet, and conveys the paper P onto the conveyer 30 through a pair of pickup rollers 23.

The conveyor 30 is provided with two belt rollers 31 and 32, and an endless paper conveyor belt 33 stretched between the two belt rollers 31 and 32. The conveyor 30 performs conveying operation of conveying the paper P from the paper feed roller 22 on the paper conveying belt 33 to the fixing unit 80, while one of the belt rollers 32 is rotatingly driven by the not-shown motor, and the other belt roller 31 is followingly rotated as well as the paper conveyer belt 33. By the conveying operation, the paper P conveyed on the paper conveyer belt 33 contacts the after-mentioned four photoconductor drums 41K, 41Y, 41M and 41C one by one in this order.

The four process cartridges 40K, 40Y, 40M and 40C respectively corresponding to four printing colors of black (K), yellow(Y), magenta(M) and cyan(C) are arranged in parallel in the horizontal direction along the upper surface of the paper conveyer belt 33. The respective process cartridges 40K, 40Y, 40M and 40C are provided with the photoconductor drums 41K, 41Y, 41M and 41C, scorotron chargers 42K, 42Y, 42M and 42C, and developing units 50K, 50Y, 50M and 50C.

The photoconductor drums 41K, 41Y, 41M and 41C includes a drum made of a metal blank tube (e.g. aluminum) having a surface of its main body covered with a photoconductive layer including an organic photoconductor containing polycarbonate as a main component. The photoconductor drums 41K, 41Y, 41M and 41C are arranged in parallel in the horizontal direction along the upper surface of the paper conveyer belt 33. The photoconductor drums 41K, 41Y, 41M and 41C are rotatingly driven so as to move in the same direction as the paper conveyer belt 33, i.e., in a counterclockwise direction in FIG. 3, in contact portions with the paper conveyer belt 33.

The respective scorotron chargers 42K, 42Y, 42M and 42C provided corresponding to the respective photoconductor drums 41K, 41Y, 41M and 41C are fixed upstream (upstream in the rotating direction of the photoconductor drums 41K, 41Y, 41M and 41C) from contact areas of the photoconductor drums 41K, 41Y, 41M and 41C with the after-mentioned developing roller 52K, 52Y, 52*m* and 52C, and at a predetermined distance apart from the surfaces of the photoconductor drums 41R, 41Y, 41M and 41C to avoid contact therewith. The scorotron chargers 42K, 42Y, 42M and 42C positively charges the surfaces of the photoconductor drums 41K,. 41Y, 41M and 41C evenly by generating corona discharge from a charging wire of tungsten or the like.

The respective developing units 50K, 50Y, 50M and 50C disposed above and corresponding to the respective photoconductor drums 41K, 41Y, 41M and 410 are provided with cases 51K, 51Y, 51M and 51C, developing rollers 52K, 52Y, 52M and 52C, supply rollers 53K, 53Y, 53M and 53C, and layer thickness regulating blades 54K, 54Y, 54M and 64C.

The cases 61K, 61Y, 61M and 51C accommodate toner as a developing agent. Specifically, the case 51K of the developing unit 50K provided in the process cartridge 40K for black(K) accommodates black(K) toner, the case 51Y of the developing unit 50Y provided in the process cartridge 40Y for yellow(Y) accommodates yellow(Y) toner, the case 51M of the developing unit 50M provided in the process cartridge 40M for magenta(M) accommodates magenta(M) toner, and the case 51C of the developing unit 50C provided in the process cartridge 40C for cyan(C) accommodates cyan(C) toner.

In the color laser printer 1, a polymerized toner containing positively-charged single non-magnetic component is employed. The toner is prepared by mixing a styrene-acrylic resin formed spherically by a known polymerization method such as suspension polymerization with a coloring agent, a charge control agent, a wax and others to form toner base particles, and by further adding an additive.

The developing rollers 52K, 52Y, 52M and 52C, including metal roller shafts covered with rollers of an electrically conductive elastic material such as rubber, are positioned in facing contact with the photoconductor drums 41K, 41Y, 41M and 41C through openings formed in the lower portions of the cases 51K, 51Y, 51M and 51C. The developing rollers 52K, 52Y, 52M and 52C are rotatingly driven so as to move in the same direction as the photoconductor drums 41K, 41Y, 41M and 41C in nip points in facing contact with the photoconductor drums 41K, 41Y, 41M and 41C, i.e., so as to be rotated in the reverse direction to the rotating direction of the photoconductor drums 41K, 41Y, 41M and 41C. A predetermined developing bias is applied to the developing rollers 52K, 52Y, 52M and 52C.

The supply rollers 53K, 53Y, 53M and 53C, including metal roller shafts covered with rollers of a conductive sponge material, are positioned in facing contact with the developing rollers 52K, 52Y, 52M and 52C within the cases 51K, 51Y, 51M and 51C. The supply rollers 53K, 53Y, 53M and 53C are rotatingly driven so as to move in the reverse direction to the moving direction of the developing rollers 52K, 62Y, 52M and 52C in nip points in facing contact with the developing rollers 52K, 52Y, 52M and 52C, i.e., so as to be rotated in the same direction to the rotating direction of the developing rollers 52K, 52Y, 52M and 52C.

The layer thickness regulating blades 54K, 54Y, 54M and 54C provided above the developing rollers 52K, 52Y, 52M and 52C are fixed such that the respective end portions of the blades are pressed onto the surfaces of the developing rollers 52K, 52Y, 52M and 52C.

Figure 4:
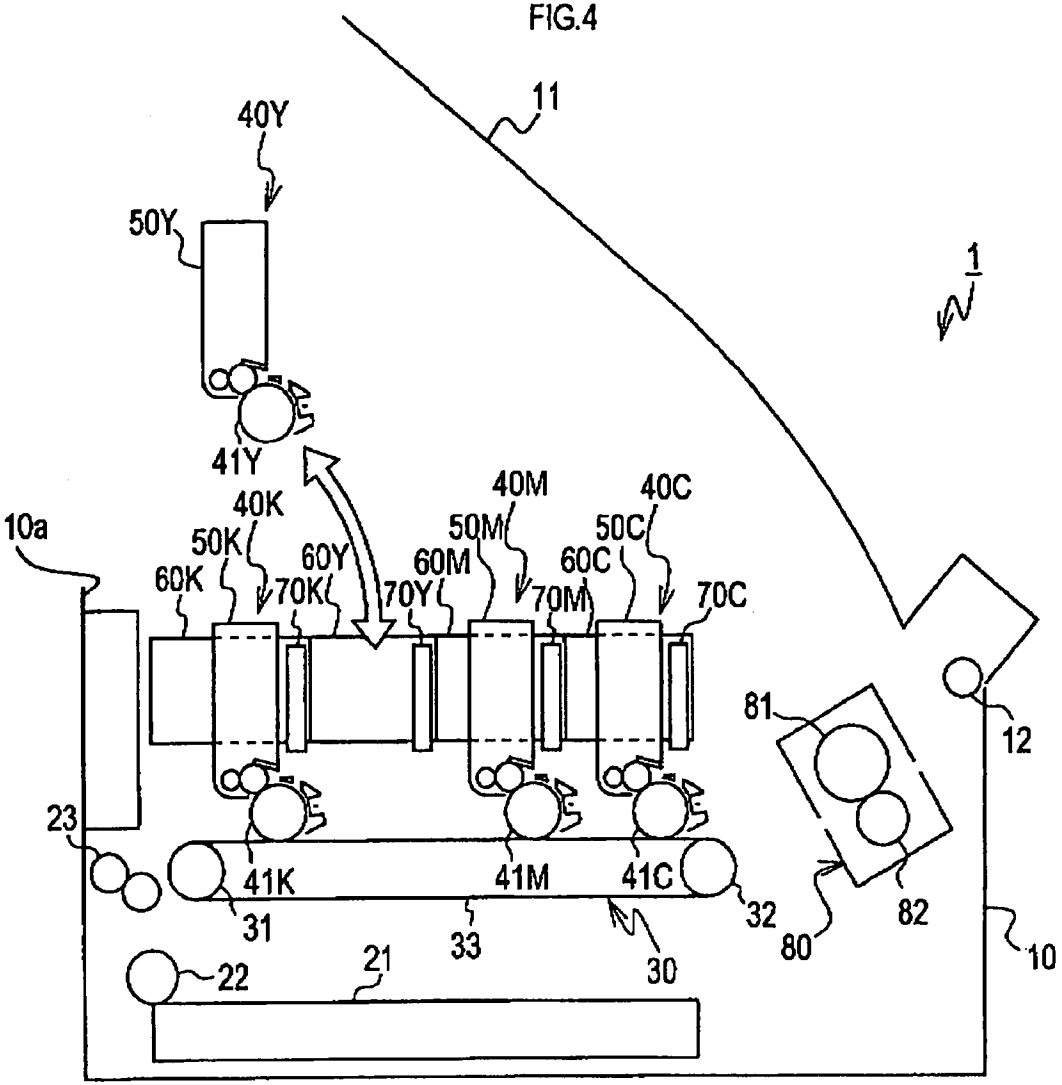
FIG. 4 is an explanatory view for illustrating attachment/detachment of a process cartridge.

Each of the process cartridges 40K, 40Y, 40M and 40C can be independently attached/detached to/from the main body casing 10. Specifically, as shown in FIG. 4, the main body casing 10 is provided with an opening-and-closing cover 11 to open and close an opening 10*a* formed on the upper side of the main body casing 10. The opening-and-closing cover 11 is supported in a rotatable manner by a hinge 12 provided on the rear side of the main body casing 10. Each of the process cartridges 40K, 40Y, 40M and 40C can be attached/detached from above while the opening-and-closing cover 11 is open.

Figure 5:
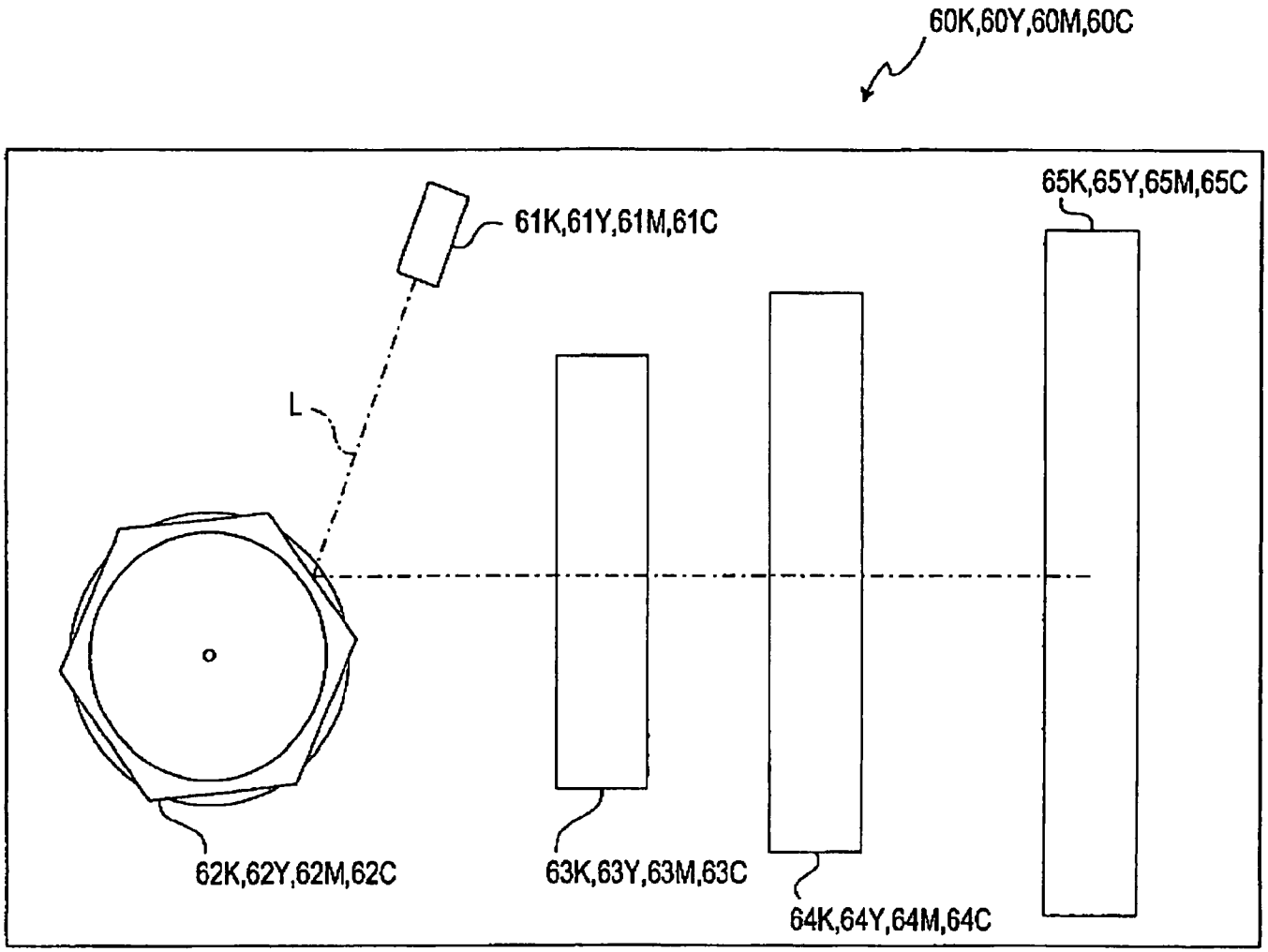
FIG. 5 is an explanatory view for illustrating the structure of a scanner unit.
Figure 6:
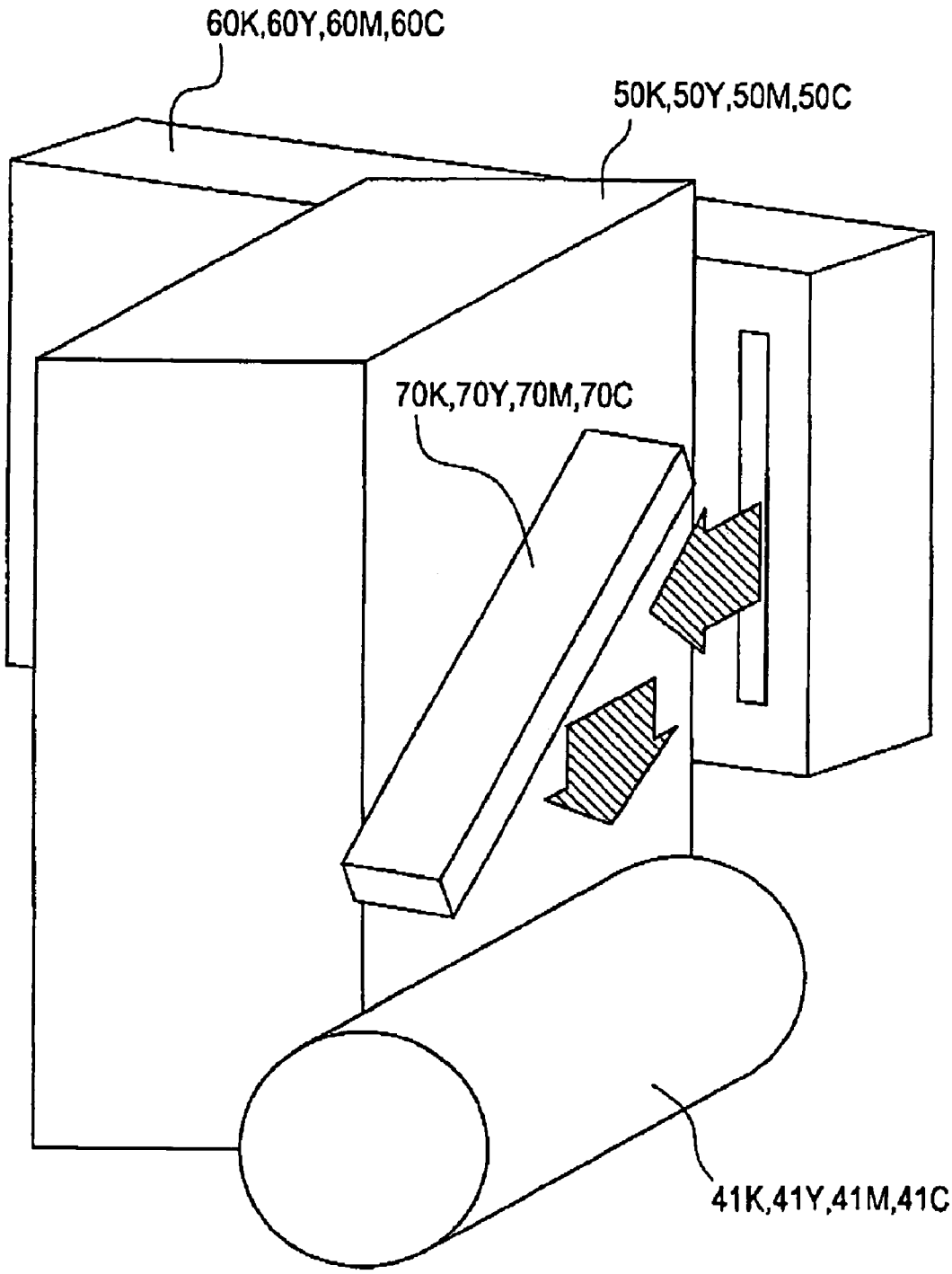
FIG. 6 is a perspective view for illustrating the arrangement of a last mirror with respect to a photoconductor drum.

The respective scanner units 60K, 60Y, 60M and 60C, as shown in FIG. 5, are provided with laser light sources 61K, 61Y, 61M and 61C generating laser lights L; polygon mirrors 62K, 62Y, 62M and 62C as scanning devices that scan the laser lights L generated by the laser light sources 61K, 61Y, 61M and 61C in specified directions; first fθ lenses 63K, 63Y, 63M and 63C, and second fθ lenses 64K, 64Y, 64M and 64C that regulate the scanning speed of the laser lights L scanned by the polygon mirrors 62K, 62Y, 62M and 62C; and reflection mirrors 65K, 65Y, 65M and 65C that reflect the laser lights L from the second fθ lenses 64K, 64Y, 64M and 64C to change their directions, thereby making the laser lights L go outside. Since the reflecting surfaces of the reflection mirrors 65K, 65Y, 65M and 65C are parallel to the scanning direction of the laser lights L, the direction change of the laser lights L by the reflection mirrors 65K, 65Y, 65M and 65C will not lead to changes of scanning directions of the laser lights L. That is, the reflection mirrors are conventionally used ones.

The respective scanner units 60K, 60Y, 60M and 60C are provided corresponding to the respective process cartridges 40K, 40Y, 40M and 40C. Specifically, the scanner units 60K, 60Y, 60M and 60C are positioned on lateral sides of the process cartridges 40K, 40Y, 40M and 40C, i.e., on end Bides in the directions of the rotation axes of the photoconductor drums 41K, 41Y, 41M and 410C so as not to face the surfaces of the photoconductor drums 41K, 41Y, 41M and 41C. The respective scanner units 60K, 60Y, 60M and 60C are arranged in parallel with the neighboring scanner units and partially overlapping one another in the directions of the rotation axes of the photoconductor drums 41K, 41Y, 41M and 41C. This allows shorter distances among the neighboring photoconductor drums 41K, 41Y, 41M and 41C.

The scanner units 60K, 60Y, 60M and 60C emit the laser lights L scanned in directions different from the directions of the rotation axes of the photoconductor drums 41K, 41Y, 41M and 41C, i.e., a direction s1 perpendicular to the rotation axes in the present embodiment. Specifically the laser lights are emitted to be scanned in the same plane including the rotation axes of the photoconductor drums 41K, 41Y, 41M and 41C at a specified angle, i.e., the center lines of the laser lights L are in the directions of the rotation axes of the photoconductor drums 41K, 41Y, 41M and 41C.

The last mirrors 70K, 70Y, 70M and 70C produced by depositing aluminum onto the surface of a glass base material are fixedly positioned by the main body case 10 so as to face the surfaces of the photoconductor drums 41K, 41Y, 41M and 41C. Specifically, the reflection surfaces of the last mirrors 70K, 70Y, 70M and 70C are arranged so as to make an angle of 45 degrees with respect to directions of the rotation axes of the photoconductor drums 41K, 41Y, 41M and 41C.

The last mirrors 70K, 70Y, 70M and 70C reflect the laser lights L emitted by the scanner units 60K, 60Y, 60M and 60C in tho directions of the rotation axes of the photoconductor drums 41K, 41Y, 41M and 41C to change the traveling direction of the laser lights L by 90 degrees, thereby to irradiate the surfaces of the photoconductor drums 41K, 41Y, 41M and 41C.

Thus, laser lights L in the scanning direction s1 emitted by the scanner units 60K, 60Y, 60M and 60C are changed their directions so as to be scanned in the same scanning direction s2 as the direction of rotation axes of the photoconductor drums 41K, 41Y, 41M and 41C. In this case, the traveling distance of the laser lights L may be the same as in a conventional case of not using the last mirrors 70K, 70Y, 70M and 70C, which may allow diversion of an fθ lense used in a conventional.

Figure 7:
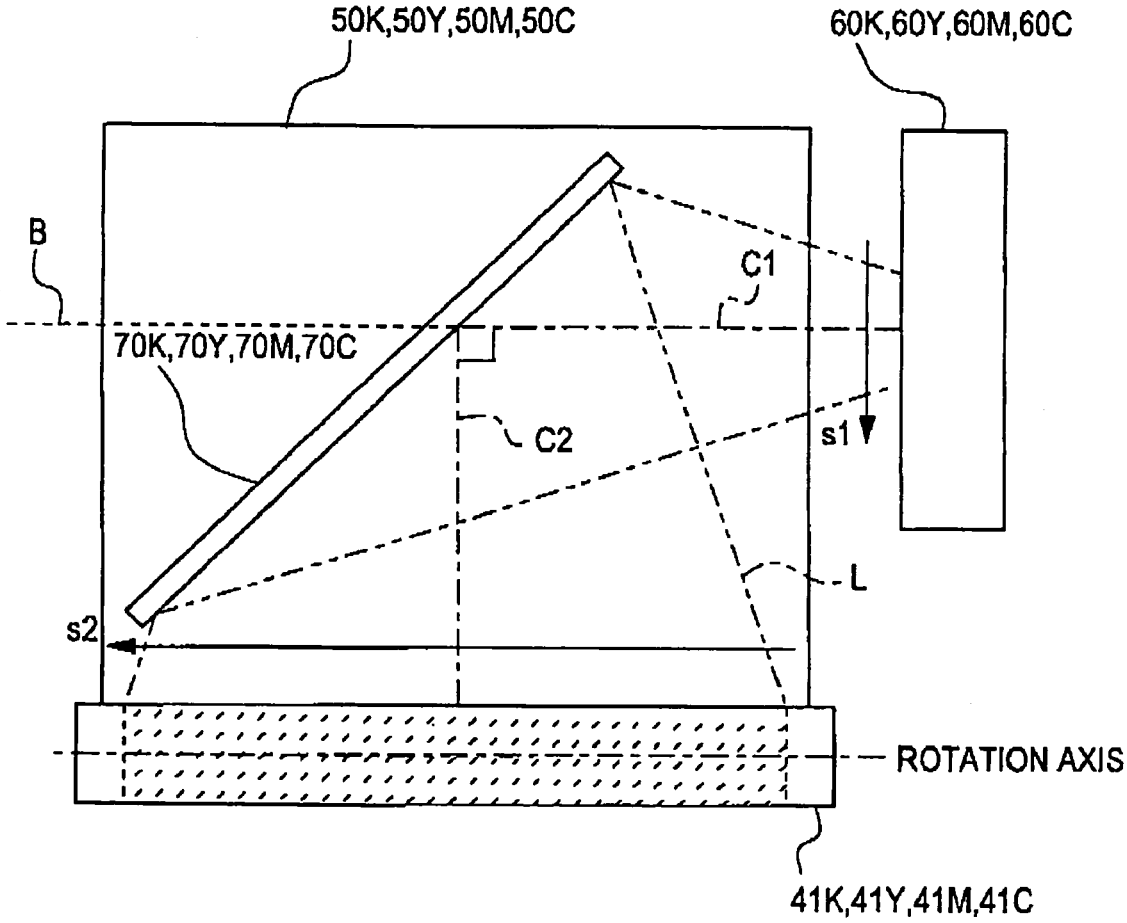
FIG. 7 is a plan view for illustrating the arrangement of the last mirror with respect to the photoconductor drum.
Figure 8:
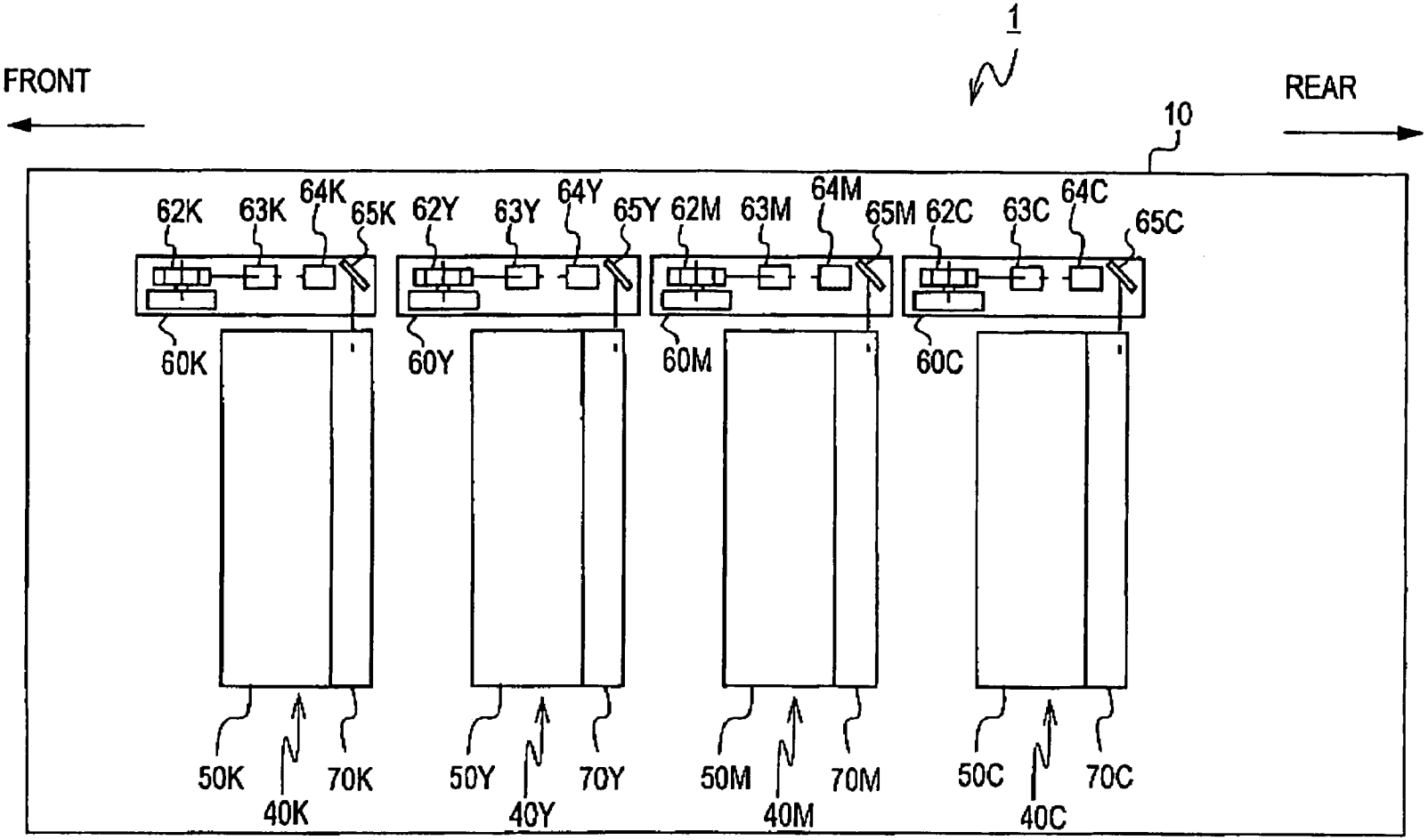
FIG. 8 is a diagrammatic cross-sectional view seen from an upper side of a color laser printer provided with each scanner unit not overlapping a neighboring scanner unit.

A plane including the center line of the laser light L before the change in direction (above-described condition (1)), and also perpendicular to a plane on which the laser light L before the change in direction is scanned (above-described condition (2)) is here called a plane B, which is positioned on the same linear line as the center line C1 in FIG. 7. As shown in FIG. 7, the center line C2 of the laser light. L after the change in direction is changed its direction so as not to be along the plane B. The change in direction as above facilitates arrangement of the scanner units 60K, 60Y, 60M and 60C so as not to face the surfaces of the photoconductor drums 41K, 41Y, 41M and 41C.

The fixing unit 80 is provided with a heating roller 81 housing a heater (e.g. a halogen lamp) therein and a pressure roller 82 pressed onto the heating roller 81.

Next, the printing operation of the color laser printer 1 as an image forming operation will be described.

First, the surfaces of the rotatingly driven photoconductor drums 41K, 41Y, 41M and 41C are positively charged evenly by the scorotron chargers 42K, 42Y, 42M and 42C.

Subsequently, the laser lights L emitted from the scanner units 60K, 60Y, 6OM and 60C are reflected by the last mirrors 70K, 70Y, 70M and 70C to be irradiated onto the surfaces of the photoconductor drums 41K, 41Y, 41M and 41C. The surfaces of photoconductor drums 41K, 41Y, 41M and 41C in a charged state are exposed to form electrostatic latent images based on given image data.

Then, the electrostatic latent images formed on the surfaces of the photoconductor drums 41K, 41Y, 41M and 41C are developed with toner of respective colors. That is, the electrostatic latent images are visualized by being developed into toner images as developing agent images. The toner images of respective colors formed on the surfaces of the electrostatic latent images are sequentially transferred to the paper P conveyed on the paper conveyer belt 33 to form a color toner image.

The color toner image transferred on the paper P is thermally fixed on the paper P by the fixing unit 80, and thus, a printed image is obtained.

To replace the process cartridges 40K, 40Y, 40M and 40C in the color laser printer 1, the opening/closing cover 11 is opened, and the process cartridges 40K, 40Y, 40M and 40C to be replaced are ejected in directions departing from the paper conveyer belt 33. The attachment/detachment of the process cartridges 40K, 40Y, 40M and 40C is not obstructed by the scanner units 60K, 60Y, 60M and 60C.

According to the color laser printer 1 of the present embodiment, as described above, the scanner units 60K, 60Y, 60M and 60C may be arranged not to face the surfaces (i.e., the exposed surfaces) of the photoconductor drums 41K, 41Y, 41M and 41C, but also to be positioned on the lateral sides of the developing units 50K, 50Y, 50M and 50C. In the color laser printer 1, therefore, the distances among the photoconductor drums 41K, 41Y, 41M and 41C may be shortened, compared with the case of arranging the scanner units 60K, 60Y, 60M and 60C among the developing units 50K, 50Y, 50M and 50C, thereby to achieve downsizing of the color laser printer 1.

In addition, obstruction of attachment/detachment of the process cartridges 40K, 40Y, 40M and 40C from above by the scanner units 60K, 60Y, 60M and 60C may be avoided.

Furthermore, the shortened distances among the photoconductor drums 41K, 41Y, 41M and 41C will promote improvement in the quality of the printed image, i.e., the overlay accuracy of the toner images of respective colors.

Also, according to the color laser printer 1, the respective scanner units 60K, 60Y, 60M and 60C are arranged side by side with the neighboring scanner units and partially overlapping one another in the directions of the rotation axes of the photoconductor drums 41K, 41Y, 41M and 41C. This will allow further shorter distances among the photoconductor drums 41K, 41Y, 41M and 41C.

Furthermore, according to the color laser printer 1, the last mirrors 70K, 70Y, 70M and 70C are fixed to the main body casing 10. This will increase the positioning accuracy of the last mirrors 70K, 70Y, 70M and 70C.

Also, according to the color laser printer 1, the process cartridges 40K, 40Y, 40M and 40C are adapted to be ejected in directions departing from the paper conveyer belt 33. This facilitates easy attachment/detachment of the process cartridges 40K, 40Y, 40M and 40C, as well as a decrease in manufacturing cost of the color laser printer 1.

Specifically, for example, in the case of removing the process cartridges 40K, 40Y, 40M and 40C along the surface of the paper conveyer belt 33, i.e., the surface of the paper conveyer belt 33 contacting the photoconductor drums 41K, 41Y, 41M and 41C, it is necessary to move the process cartridges 40K, 40Y, 40M and 40C first in directions departing from the photoconductor drums 41K, 41Y, 41M and 41C, and then along the surface of the paper conveyer belt 33. This leads to a complicated attaching/detaching operation of the process cartridges 40K, 40Y, 40M and 40C, as well as to a complicated mechanism and a resulting increase in manufacturing cost of a color laser printer.

Particularly in the case of removing the process cartridges 40K, 40Y, 40M and 40C along the surface of the paper conveyer belt 33 and also in directions perpendicular to the rotation axes of the photoconductor drums 41K, 41Y, 41M and 41C, i.e., in a direction parallel with the conveying direction of the paper P, all the process cartridges 40K, 40Y, 40M and 40C need to be attached/detached at the same time. This leads to a difficult attaching/detaching operation and an unstable state of the color laser printer due to a large shift of the center of gravity. In contrast, according to the color laser printer 1, the process cartridges 40K, 40Y, 40M and 40C can be attached/detached independently, facilitating easy attaching/detaching operation and reducing the shift of the center of gravity during attachment/detachment.

The scanner units may be configured to be shifted during attachment/detachment of the process cartridges. Even when the scanner units are arranged on a side of the process cartridges opposite to a side facing the paper conveyer belt, like the structure described in the above-mentioned Publication of Unexamined Japanese Patent Application No. 2003-15378, for example, if the scanner units are fixed to the opening/closing cover adapted to open/close the upper side of the main body case, the scanner unit can be shifted by opening the opening/closing cover. The process cartridges, therefore, may be removed in a direction departing from the paper conveyer belt. However, such a structure is undesirable because of a resulting decrease in positioning accuracy of the scanner units with respect to the photoconductor drums. The structure is also undesirable in view of a difficult opening/closing operation due to a heavy opening/closing cover and of possible adverse effects on the scanner units due to the shock at the time of opening/closing of the cover.

Although one embodiment of the present invention has been described as above, it is to be understood that the present invention may be practiced in various forms.

For example, while the respective scanner units 60K, 60Y, 60M and 60C are arranged side by side with the neighboring scanner units and partially overlapping one another in the directions of the rotation axes of the photoconductor drums 41K, 41Y, 41M and 41C in the color laser printer 1 of the above embodiment, the scanner units may be arranged in different manners. Specifically, for example, the respective scanner units 60K, 60Y, 60M and 60C may be arranged side by side with the neighboring scanner units without overlapping one another in the directions of the rotation axes of the photoconductor drums 41K, 41Y, 41M and 41C.

The last mirrors 70K, 70Y, 70M and 70C, which are fixed on the main body case 10 in the color laser printer 1 of the above embodiment, may be provided in other manners.

Figure 9:
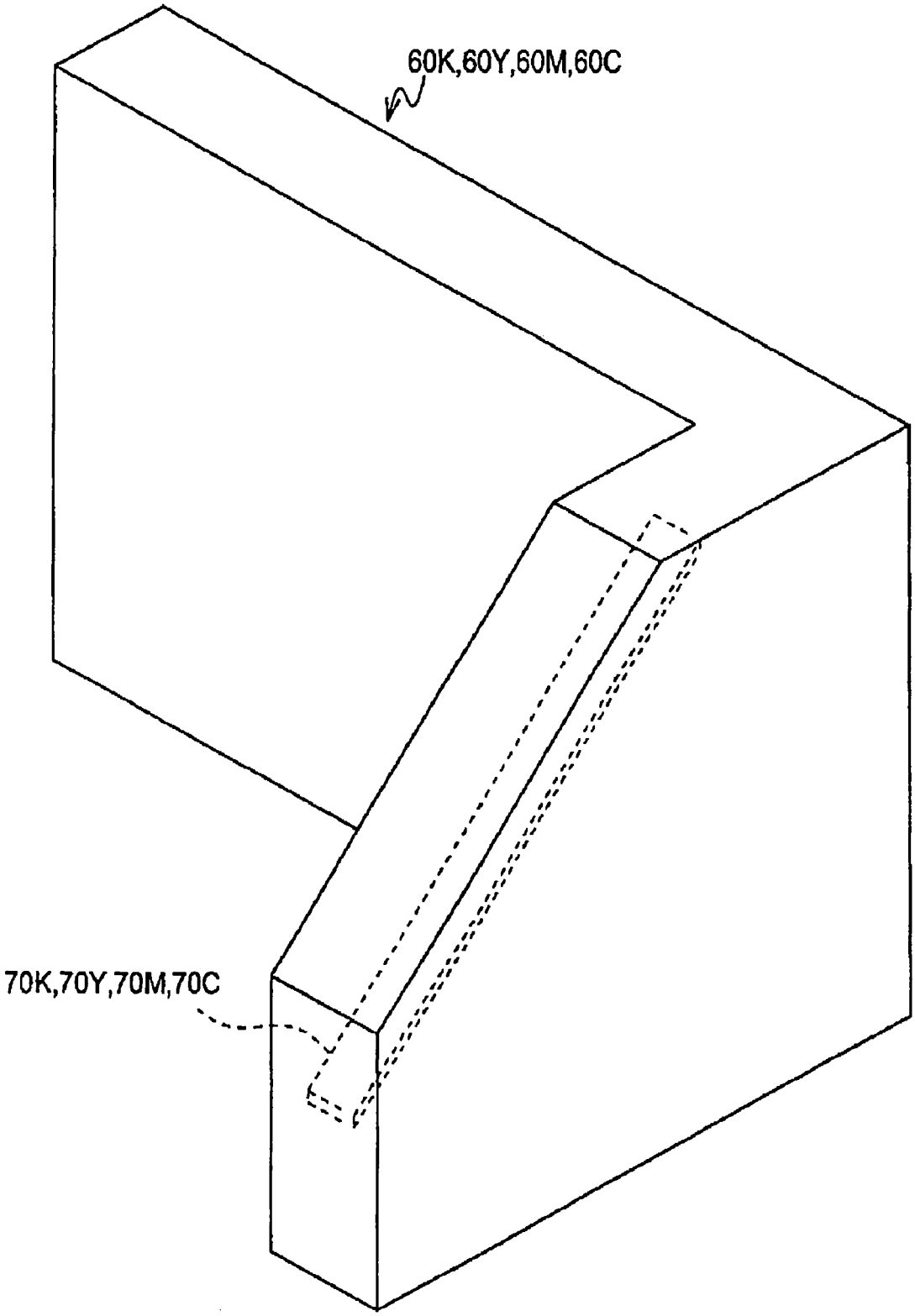
FIG. 9 is a perspective view of a scanner unit provided with an integral last mirror.

For example, as shown in FIG. 9, the last mirrors 70K, 70Y, 70M and 70C may be provided integrally with the respective scanner units 60K, 60Y, 60M and 60C. Such a configuration can lead to an extremely high positioning accuracy of the respective last mirrors 70K, 70Y, 70M and 70C with respect to the respective scanner units 60K, 60Y, 60M and 60C. Also, the configuration enables adjustment of the light axes of the laser lights to be performed by handling only the respective scanner units 60K, 60Y, 60M and 60C during manufacturing of the color laser printer 1. In addition, to house the last mirrors 70K, 70Y, 70M and 70C, and the scanner units. 60K, 60Y, 60M and 60C in the same case can reduce adverse effects of the toner and dust.

Figure 10:
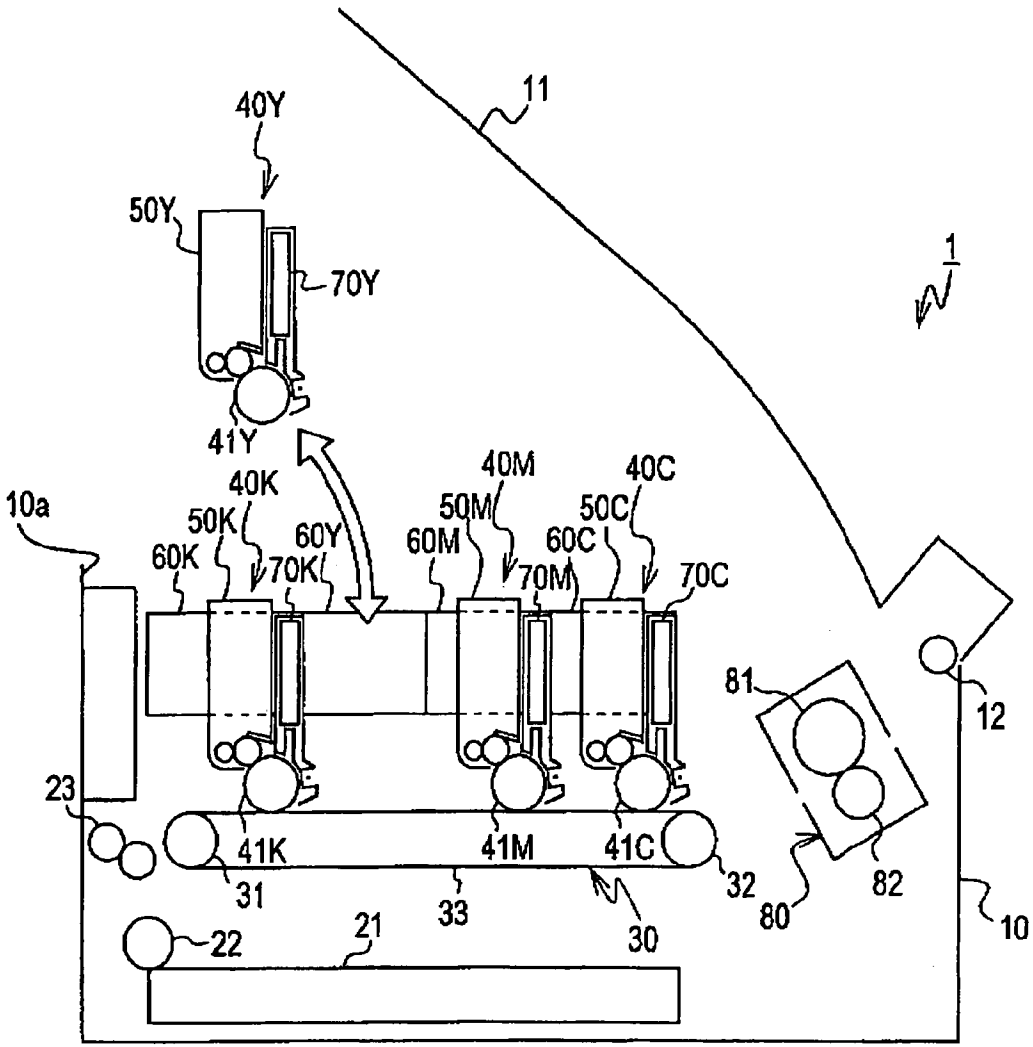
FIG. 10 is an explanatory view for illustrating attachment/detachment of a process cartridge provided with an integral last mirror.

Alternatively, the last mirrors 70K, 70Y, 70M and 70C may be provided integrally with the respective process cartridges 40K, 40Y, 40M and 40C. In this case, as shown in FIG. 10, the last mirrors 70K, 70Y, 70M and 70C do not remain in the color laser printer 1 during attachment/detachment of the process cartridges 40K, 40Y, 40M and 40C. Accordingly, obstruction of attachment/detachment of the process cartridges 40K, 40Y, 40M and 40C (especially the photoconductor drums 41K, 41Y, 41M and 41C) by the last mirrors 70K, 70Y, 70M and 70C can be avoided. This allows much shorter distances among the neighboring photoconductor drums 41K, 41Y, 41M and 41C.

Figure 11:
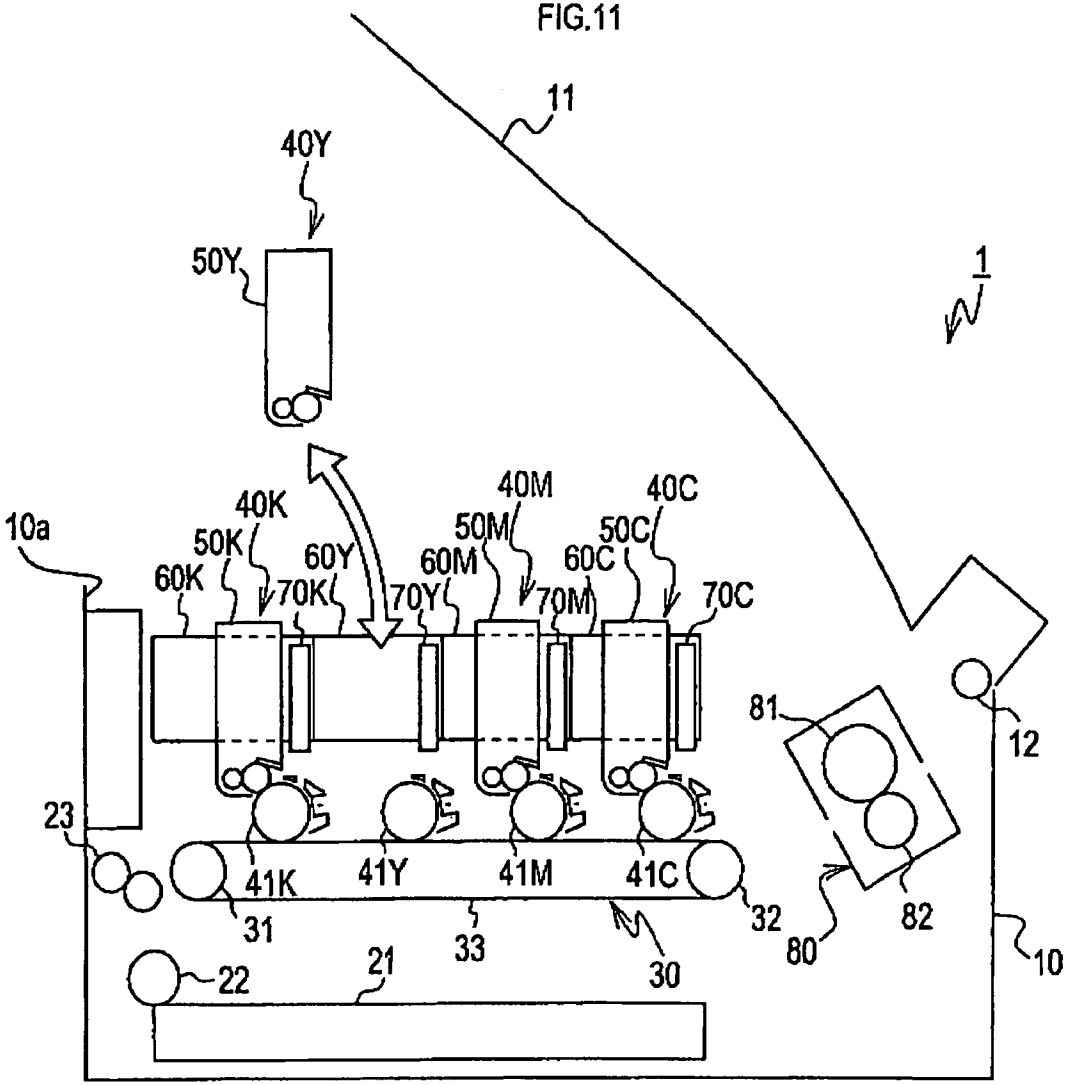
FIG. 11 is an explanatory view for illustrating attachment/detachment of a process cartridge provided only with an developing unit.
Figure 12:
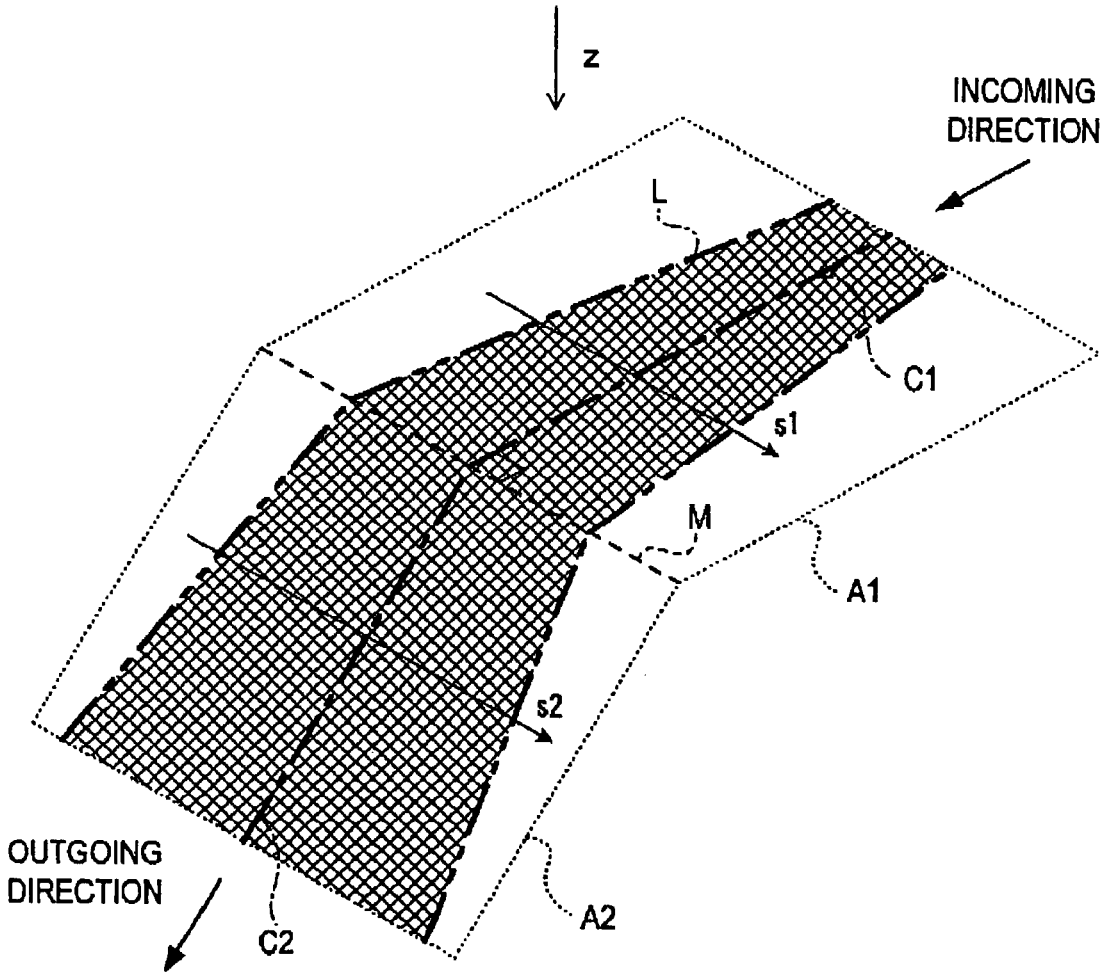
FIG. 12 is a perspective view for illustrating a direction change not corresponding to a direction change by a direction changing device according to the present invention.
Figure 13:
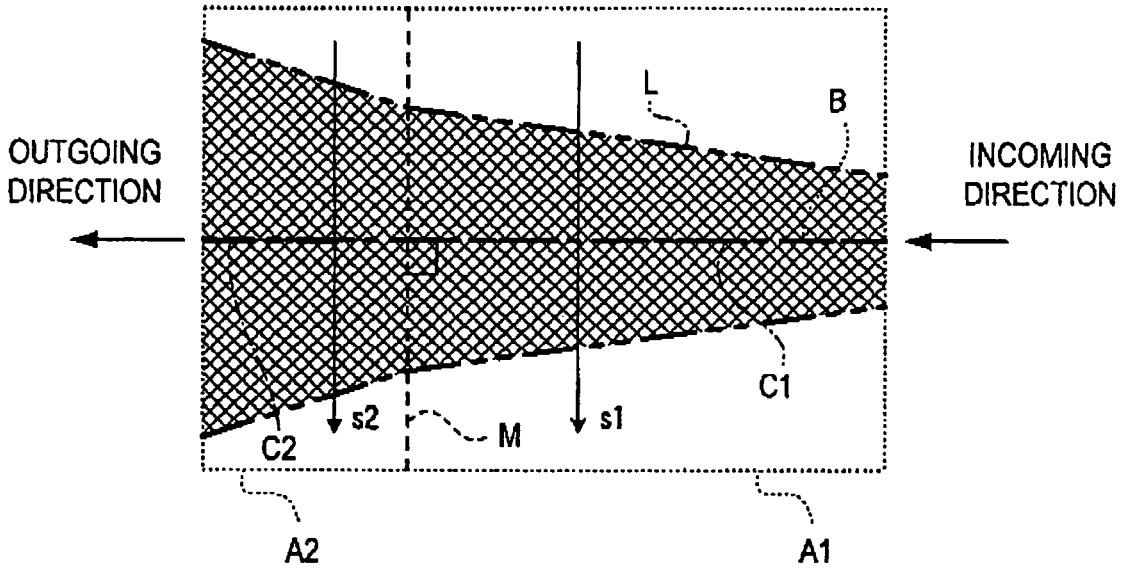
FIG. 13 is a top plan view for illustrating the direction change not corresponding to a direction change by the direction changing device according to the present invention.
Figure 14:
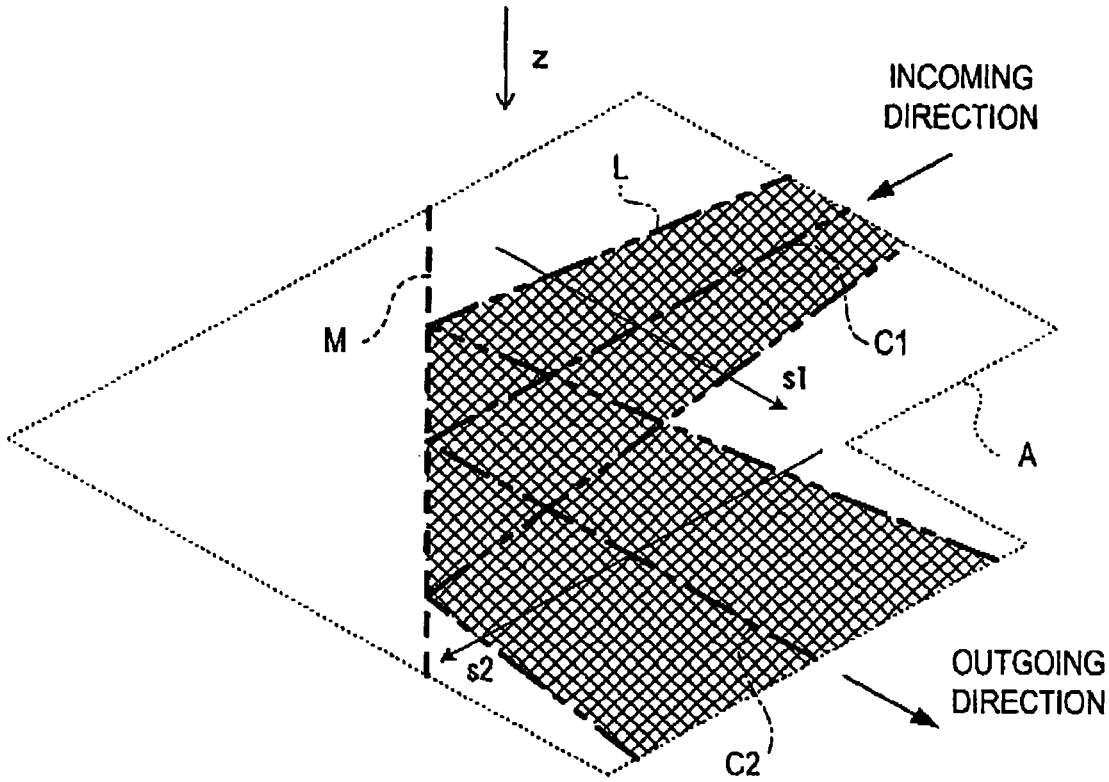
FIG. 14 is a perspective view for illustrating a direction change corresponding to a direction change by the direction changing device according to the present invention.
Figure 15:
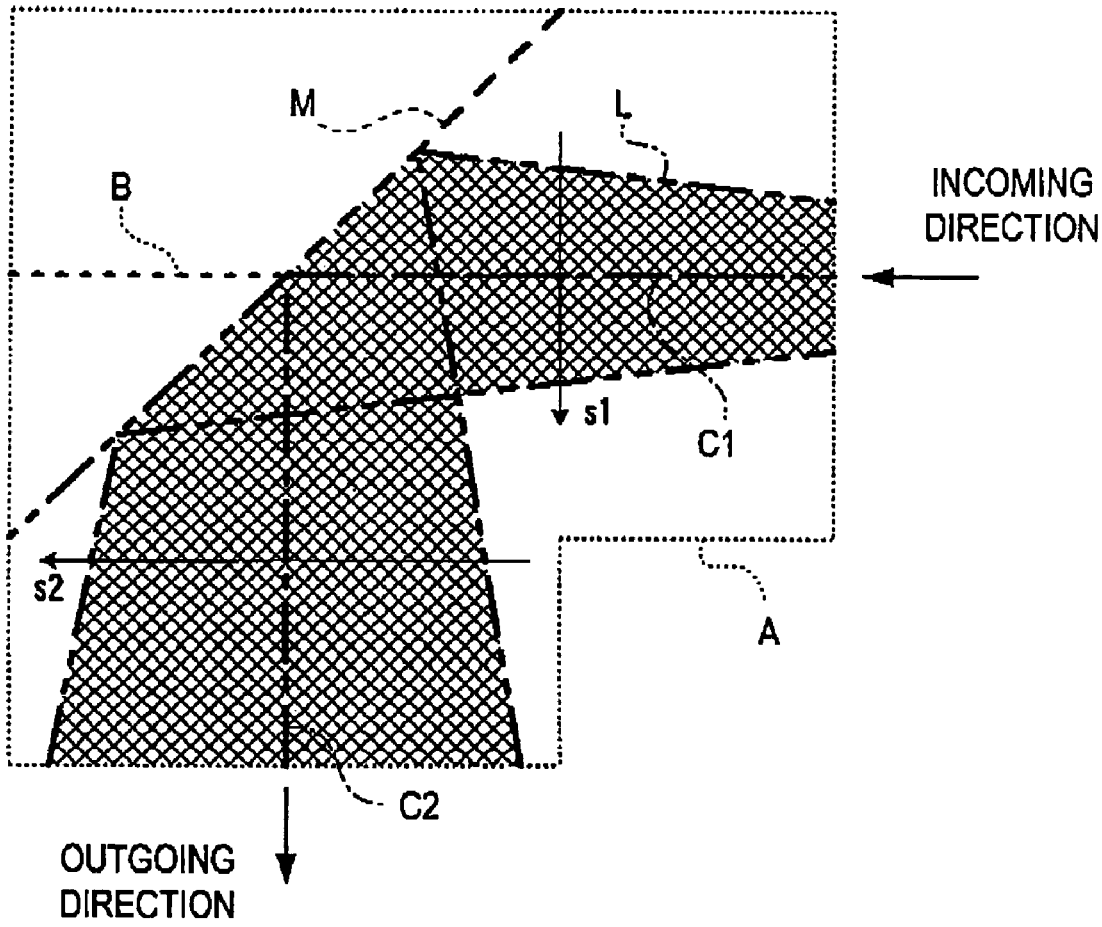
FIG. 15 is a top plan view for illustrating the direction change corresponding to a direction change by the direction changing device according to the present invention.

The process cartridges 40K, 40Y, 40M and 40C, which include the photoconductor drums 41K, 41Y, 41M and 41C therein in the color laser printer 1 of the present embodiment, may not include the photoconductor drums 41K, 41Y, 41M and 41C, but include only the developing units 50K, 50Y, 50M and 50C. According to such a configuration, as shown in FIG. 11, obstruction of attachment/detachment of the process cartridges 40K, 40Y, 40M and 40C by the last mirrors 70K, 70Y, 70M and 70C can be avoided. This allows much shorter distances among the neighboring photoconductor drums 41K, 41Y, 41M and 41C. In such a configuration, for example, the photoconductor drums 41K, 41Y, 41M and 41C may preferably be attachable/detachable in the direction of the rotation axes. This facilitates replacement of the photoconductor drums 41K, 41Y, 41M and 41C in case of deterioration.

Also, the laser lights L after the change in direction by the last mirrors 70K, 70Y, 70M and 70C, which are scanned in the respective same planes as the laser lights L before the change in direction in the color laser printer 1 of the above embodiment, may be adapted to be scanned in different planes.

Photoconductors, which are cylindrical photoconductor drums 41K, 41Y, 41M and 41C in the color laser printer 1 of the above embodiment, may have, for example, a belt-like configuration.

The changes in directions of the laser lights L emitted by the scanner units 60K, 60Y, 60M and 60C, which are performed by reflection by the last mirrors 70K, 70Y, 70M and 70C in the color laser printer 1 of the above embodiment, may be performed by devices that refract the laser lights, such as lenses.

The photoconductor drums 41K, 41Y, 41M and 41C, which are arranged side by side in the horizontal direction in the color laser printer 1 of the above embodiment, may be arranged, for example, side by side in the vertical direction. According to such a configuration, the main body case may be provided, for example, with an opening/closing cover for opening/closing an opening formed at the front of the main body case, and the respective process cartridges may be adapted to be attached/detached independently from the front with the opening/closing cover opened.

The toner images formed on the respective photoconductor drums 41K, 41Y, 41M and 41C are transferred directly to the paper P conveyed on the paper conveyer belt 33 in the color laser printer 1 of the above embodiment. However, the toner images formed on the respective photoconductor drums may be first transferred to an intermediate transfer belt, and then transferred from the intermediate transfer belt to the paper P.

The present invention may be applied not only to a tandem color laser printer, but also to, for example, a so-called 4 cycle color laser printer, in which toner images in respective colors are sequentially formed on a photoconductor common to developing units for respective colors, and the toner images are sequentially transferred in a superimposing manner onto an object to which transfer is performed, such as paper or an intermediate transfer belt, thereby to form a color toner image on the object. Also in this case, there is an advantage in that a high flexibility in arrangement of scanner units with respect to the photoconductor can be achieved.

The present invention also may be applied not only to color laser printers, but also to black-and-white laser printers.

What is claimed is:

1. An image forming apparatus comprising:

a rotatable endless belt;

rotatable photoconductors of N in number ($N \geqq 2$) arranged side by side along the endless belt;

charging devices of N in number provided corresponding to the respective photoconductors of N in number that charge surfaces of the photoconductors;

at least one exposure device that exposes the photoconductors charged by the charging devices to form electrostatic latent images on the photoconductors;

developing devices of N in number provided corresponding to the respective photoconductors of N in number that respectively develop the electrostatic latent images on the photoconductors with developing agents in different colors to form developing agent images; and process cartridges provided in an attachable and detachable manner, the process cartridges including at least the developing devices, wherein the at least one exposure device includes:

an exposure scanning unit that emits a laser light scanned in a same, plane and at a specified angle; and a direction changing device that changes the direction of the laser light emitted by the exposure scanning unit such that a center line of the laser light after a direction change is directed not to pass a plane including a center line of the laser light before the direction change and perpendicular to a plane in which the laser light before the direction change is scanned.

2. The image forming apparatus according to claim 1, wherein the exposure scanning unit is provided corresponding to each of the photoconductors of N in number such that the exposure scanning unit partially overlaps neighboring exposure scanning units.

3. The image forming apparatus according to claim 1, wherein the direction changing device is a mirror having a reflecting surface arranged at an angle of 45° with respect to a rotation axis of the photoconductor.

4. The image forming apparatus according to claim 1, wherein the direction changing device is provided integrally with the process cartridge.

5. The image forming apparatus according to claim 1, wherein the direction changing device is attached to a main body of the image forming apparatus.

6. The image forming apparatus according to claim 5, wherein the direction changing device is provided integrally with the exposure scanning unit.

7. The image forming apparatus according to claim 5, wherein the process cartridge does not include the photoconductor, and wherein the photoconductor is adapted to be attachable and detachable in a rotation axis of the photoconductor.

8. An image forming apparatus comprising:

a rotatable endless belt;

rotatable photoconductors of N in number ($N \geqq 2$) arranged side by side along the endless belt;

charging devices of N in number provided corresponding to the respective photoconductors of N in number that charge surfaces of the photoconductors;

at least one exposure device that exposes the photoconductors charged by the charging devices to form electrostatic latent images on the photoconductors;

developing devices of N in number provided corresponding to the respective photoconductors of N in number that respectively develop the electrostatic latent images on the photoconductors with developing agents in different colors to form developing agent images; and process cartridges provided in an attachable and detachable manner, the process cartridges including at least the developing devices, wherein the at least one exposure device includes:

an exposure scanning unit that emits a laser light scanned in a direction different from a direction of a rotation axis of the photoconductor; and a direction changing device that changes the direction of the laser light emitted by the exposure scanning unit such that the laser light is scanned in the same direction as the direction of the rotation axis of the photoconductor.

9. The image forming apparatus according to claim 8, wherein the exposure scanning unit is provided corresponding to each of the photoconductors of N in number such that the exposure scanning unit partially overlaps neighboring exposure scanning units.

10. The image forming apparatus according to claim 8, wherein the direction changing device is a mirror having a reflecting surface arranged at an angle of 45° with respect to a rotation axis of the photoconductor.

11. The image forming apparatus according to claim 8, wherein the direction changing device is provided integrally with the process cartridge.

12. The image forming apparatus according to claim 8, wherein the direction changing device is attached to a main body of the image forming apparatus.

13. The image forming apparatus according to claim 12, wherein the direction changing device is provided integrally with the exposure scanning unit.

14. The image forming apparatus according to claim 12, wherein the process cartridge does not include the photoconductor, and wherein the photoconductor is adapted to be attachable and detachable in a rotation axis of the photoconductor.

15. An image forming apparatus comprising:

a rotatable photoconductor;

a charging device that charges a surface of the photoconductor;

an exposure device that exposes the photoconductors charged by the charging device to form an electrostatic latent image on the photoconductor; and a developing device that develops an electrostatic latent image on the photoconductor with a developing agent to form a developing agent image, wherein the exposure device includes:

an exposure scanning unit that emits a laser light scanned in a same plane and at a specified angle; and a direction changing device that changes the direction of the laser light emitted by the exposure scanning unit such that a center line of the laser light after a direction change is directed not to pass a plane including a center line of the laser light before the direction change and perpendicular to a plane in which the laser light before the direction change is scanned.

16. An image forming apparatus comprising:

a rotatable photoconductor;

a charging device that charges a surface of the photoconductor;

an exposure device that exposes the photoconductors charged by the charging device to form an electrostatic latent image on the photoconductor; and a developing device that develops an electrostatic latent image on the photoconductor with a developing agent to form a developing agent image, wherein the exposure device includes:

an exposure scanning unit that emits a laser light scanned in a direction different from a direction of a rotation axis of the photoconductor; and a direction changing device that changes the direction of the laser light emitted by the exposure scanning unit such that the laser light is scanned in the same direction as the direction of the rotation axis of the photoconductor.

17. A process cartridge adapted to be attachable and detachable to and from an image forming apparatus, comprising:

a developing device that develops with a developing agent an electrostatic latent image formed on a photoconductor provided to the image forming apparatus thereby to form a developing agent image, wherein a direction changing device is provided integrally with the process cartridge, the direction changing device being adapted, with the process cartridge being attached to the image forming apparatus, to change the direction of a laser light scanned in a same plane and at a specified angle such that a center line of the laser light after a direction change is directed not to pass a plane including a center line of the laser light before the direction change and perpendicular to a plane in which the laser light before the direction change is scanned.

18. A process cartridge adapted to be attachable and detachable to and from an image forming apparatus, comprising:

a developing device that develops with a developing agent an electrostatic latent image formed on a photoconductor provided to the image forming apparatus thereby to form a developing agent image, wherein a direction changing device is provided integrally with the process cartridge, the direction changing device being adapted, with the process cartridge being attached to the image forming apparatus, to change the direction of a laser light scanned in a direction different from a direction of a rotation axis of the photoconductor such that the laser light is scanned in the same direction as the direction of the rotation axis of the photoconductor.

19. An exposure scanning unit provided in an image forming apparatus to emit a laser light scanned in a same plane and at a specified angle, comprising:

a direction changing device being integral with the exposure scanning unit and adapted to change the direction of the laser light emitted by the exposure scanning unit such that a center line of the laser light after a direction change is directed not to pass a plane including a center line of the laser light before the direction change and perpendicular to a plane in which the laser light before the direction change is scanned.

20. An exposure scanning unit provided in an image forming apparatus to emit a laser light scanned in a direction different from a direction of a rotation axis of a photoconductor, comprising:

a direction changing device that changes the direction of the laser light emitted by the exposure scanning unit such that the laser light is scanned in the same direction as the direction of the rotation axis of the photoconductor.

* * * * *